United States Patent [19]

Mikhail et al.

[11] Patent Number: 5,040,396

[45] Date of Patent: Aug. 20, 1991

[54] PORTABLE INTERNAL ROLLER SWAGER

[75] Inventors: Makram T. Mikhail, Temple City, Calif.; Raymond Cloatre, Noisy le Roi, France

[73] Assignee: Sierracin Corporation, Sylmar, Calif.

[21] Appl. No.: 467,256

[22] Filed: Jan. 19, 1990

[51] Int. Cl.[5] ..... B21D 39/10

[52] U.S. Cl. ..... 72/117; 72/122; 72/125; 72/444

[58] Field of Search ..... 72/115, 117, 120, 121, 72/122, 123, 125, 444; 408/111, 112, 712; 10/89 P

[56] References Cited

U.S. PATENT DOCUMENTS

| | | | |
|---|---|---|---|
| 784,577 | 3/1905 | Lovekin | 72/125 |
| 4,087,225 | 5/1978 | Wolcott | 72/125 |
| 4,235,565 | 11/1980 | Albano | 408/712 |
| 4,242,016 | 12/1980 | Faris | 408/712 |
| 4,658,616 | 4/1987 | Bastone | 72/122 |
| 4,793,167 | 12/1988 | Beiley . | |

*Primary Examiner*—Lowell A. Larson
*Attorney, Agent, or Firm*—Charles Berman

[57] ABSTRACT

A machine, which is portable, and method for roller swaging hydraulic fitting sleeves onto metallic tubing comprises a tapered roller mandrel expander under either or both torque control of swaging or diameter control of swaging. The machine provides an automatic swaging cycle with an optimum overall time cycle for swaging performance. A motor drive is movably mounted relative to the mandrel expander assembly. The motor drive is manually moved longitudinally to activate the mandrel. Portability and hand held use can be effected by removing the power unit from the frame.

34 Claims, 3 Drawing Sheets

PORTABLE INTERNAL ROLLER SWAGER

BACKGROUND

This invention relates to roller swaging of tubing such as for attaching hydraulic fitting sleeves to high strength, thin wall, aerospace hydraulic tubing. Such swaging machines are disclosed in U.S. Pat. No. 4,658,616 (Bastone) and, U.S. Pat. No. 4,793,167 (Beiley and Mikhail), both patents being assigned to the Assignee of this application. The contents of those patents are incorporated by reference herein.

In the aerospace industry, it is commonplace to attach hydraulic fittings using roller swaging of tubing. The tube to be swaged, held in place in the roller swaging machine, receives the end of an expander assembly. A sleeve to be swaged onto the tube loosely sheaths the tube. A plurality of rollers are located at the end of the expander assembly. The rollers can freely move radially toward and away from the longitudinal axis of the expander assembly. Moving along the axis of the expander assembly, a rotating tapered mandrel frictionally engages the rollers and forces the rollers against the inner wall of the tube. A strong sealed connection between the tube and the sleeve is effected as the mandrel continues to rotate and advance, causing the rollers to expand the tube, forcing the tube material to flow into grooves in the sleeve.

Prior art roller swaging exhibits the disadvantage of non-portability. Swaging machines in the prior art are too heavy and bulky for efficient and inexpensive movement onto aircraft or marinecraft to perform on-board-/on-site installation and field repair.

Thus there is a need for a hand held, portable roller swaging machine which can perform on-board installation and field repair. Additionally, it would be advantageous if such a machine had light production capabilities and exhibited the benefits of both torque control and diameter control, burnishing, close control of the amount of swaging, long tool life, swaging at an overall high cycle speed, ease of use, and automatic operation.

SUMMARY

Accordingly, the swaging machine and method of the present invention is designed to perform on-board installation and field repair in addition to light production use.

The machine includes a roller expander having a tapered mandrel. The mandrel is rotated and advanced to expand the tube into engagement with a fitting sleeve. A motor drive rotates the mandrel. Mandrel rotation is under control of the drive motor. The machine also includes mounting means for the drive motor and expander wherein the drive motor is movably mounted relative to the expander assembly.

The machine installs metallic sleeves on hydraulic tubes by roller swaging. The mandrel operates in a swaging cycle after the operator moves the drive motor longitudinally toward the mandrel to activate the mandrel. The mandrel rotates and feeds into a tube to expand the tube into engagement with a sleeve.

The portable automatic roller swaging machine performs on-board installations and field repair in addition to light production use.

DRAWINGS

These and other features, aspects, and advantages of the present invention will become better understood with reference to the following descriptions, appended claims, and accompanying drawings where:

DESCRIPTION

Figure 1:
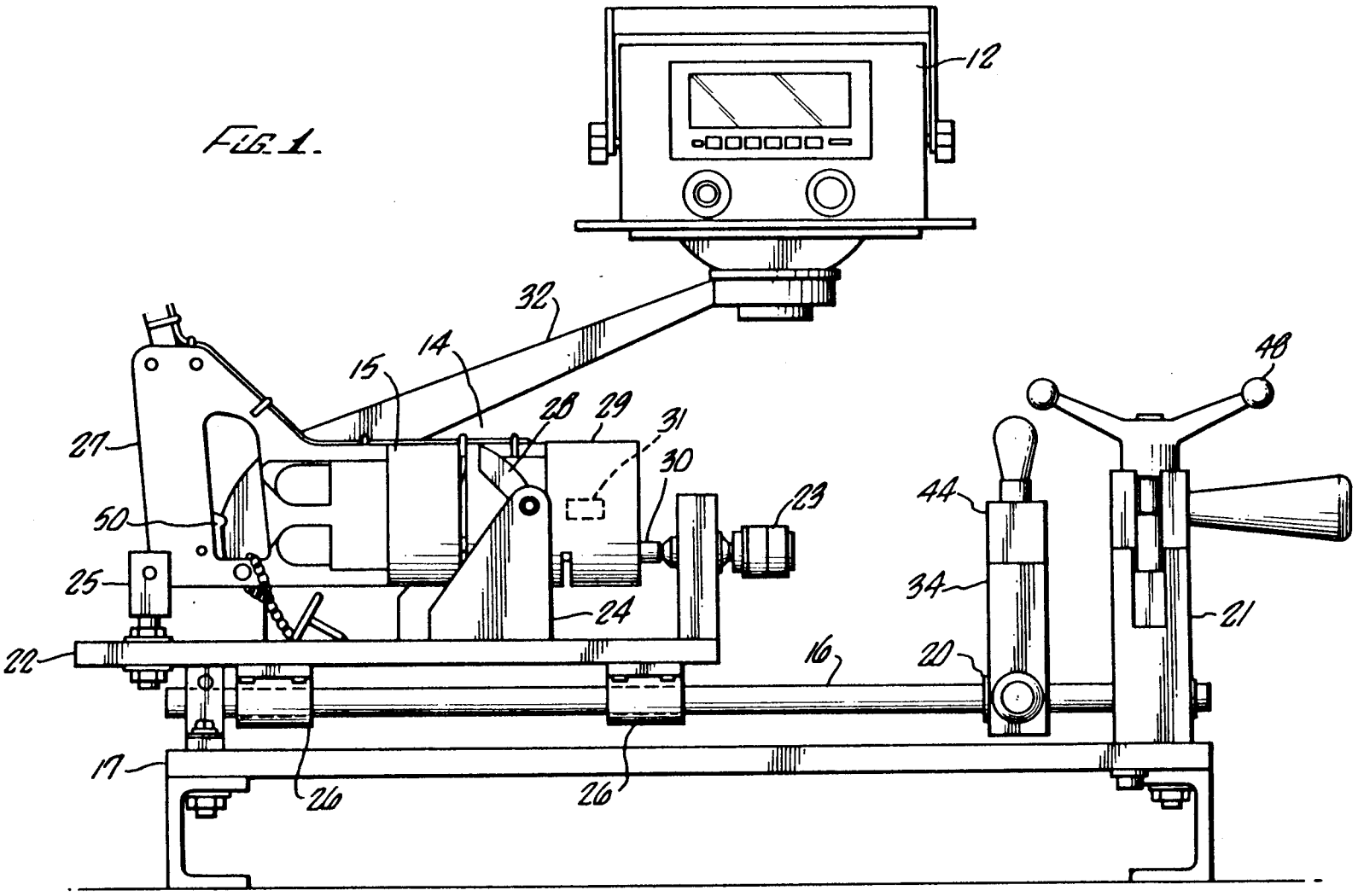
FIG. 1 is a side view of a portable internal roller swaging machine according to the present invention, the machine incorporating a tube expander holder in a slide, a vise member, a drive and drive motor for rotating a mandrel, control means for the drive, and mounting means upon which the drive motor and expander assembly are movably mounted relative to each other.
Figure 2:
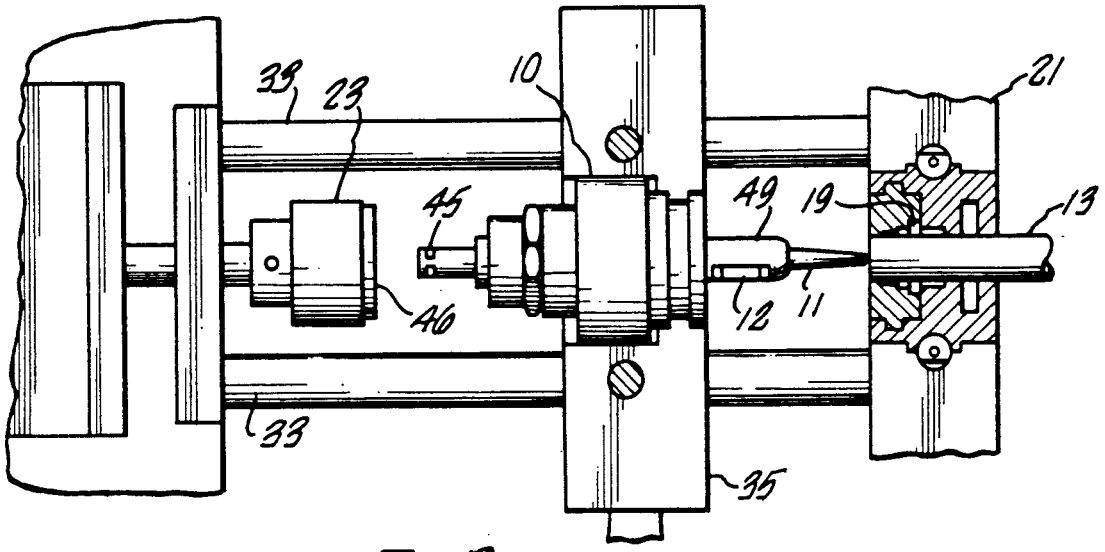
FIG. 2 is an enlarged fragmentary sectional top view of the connector, expander assembly, mandrel and vise member.
Figure 3:
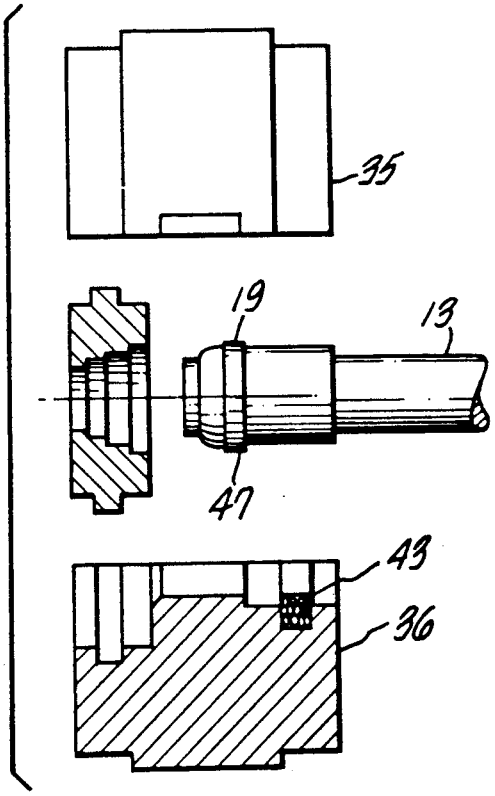
FIG. 3 is an enlarged fragmentary sectional side view of the two half jaws of the vise member, a sleeve and tube and tube retainer.

The semi-automatic automatic roller swaging machine is used to install end fittings, flareless and flared, lightweight unions, and dynamic beam seals as well as internally swaged fittings onto corrosion resistant steel, titanium, aluminum and other tubing of materials commonly used for aircraft, marine, and other similar type applications.

A portable machine for swaging and installing a metallic sleeve on a metallic tube comprises an expander assembly 10 having a tapered mandrel 11 for engaging a plurality of tapered rollers 12 for expanding the tube 13 as the mandrel 11 is rotated and advanced on its axis. The machine includes a drive 14 for rotating the mandrel 11 in a swaging cycle. The drive includes a drive motor 15. Mounted movably relative to each other on mounting means 16 are the drive motor 15 and the expander assembly 10. The mounting means 16 is itself mounted on a portable frame 17. The drive speeds are manually selected on the control means 18 based upon whether torque control or diameter control is used. Computerized control means 18 govern the speed of the drive 14 to automatically achieve, according to the drive speeds manually selected, rotation of the mandrel 11 to effect expansion of the tube 13 resulting in the installation of the tube into the sleeve 19.

The expander assembly 10 includes engaging means 20 between the expander assembly 10 and the mounting means 16 such that the expander assembly 10 is movable on the mounting means 16.

The mounting means 16 extend longitudinally from one end of the portable frame 17 to the opposite end of the portable frame where a vise member 21 is rigidly and nonmovably mounted for anchoring the sleeve 19 and tube 13. A slide table 22 mounted on the mounting means 16 rides on the mounting means 16. The slide table 22 includes a connector 23 affixed at one end of the sliding table for coupling with the expander assembly 10. The drive motor 15 is mounted on the remaining portion of the slide table. The expander assembly 10, located on the mounting means 16 between the drive motor !5 and the vise member 21, is mounted to ride on the mounting means 16. The mounting means 16 can include a portable frame 17.

The drive motor 15 is mounted on a slide table 22 by selective attachment to brackets 24, 25. The slide table 22 is movably mounted on the mounting means 16 by pillow blocks 26, which are mounted between the slide table 22 and the mounting means 16 for facilitating movement of the drive motor 15 on the mounting means 16. Handle means 27 included on the drive motor 152 facilitate manual movement of the drive motor 15 along the mounting means 16.

The drive 14 includes a transmission assembly 28 and a torque sensor unit 29. A drive shaft 30, which is included in the drive 14, transmits rotational movement for the expander assembly 10 from the drive motor 15 through the transmission assembly 28 and the torque sensor 29. A connector 23 attached to the drive shaft 30 is driven by the rotational output from the torque sensor unit 29. The connector 23 is for coupling with the expander assembly 10.

The control means 18, which are separately mounted from the frame, is electrically connected with the torque sensor 29, the torque sensor 29 including a torque transducer 31. Electrical conductors 32 connect the torque transducer 31 with the control means 18. Contained with the control means, a motor speed control operates in combination with a microcomputer and drives the drive motor 15 motor bidirectionally to predetermined speeds for rotating the tapered mandrel 11 in an automatic swaging cycle.

The mounting means 16 can be a shaft 33 or a plurality of laterally spaced shafts 33 extending longitudinally toward the expander assembly 10. When configured as shaft means 33, the drive motor 15 and the expander assembly 10 are movable on the shaft means 33.

OPERATION

An operating sequence to perform swaging operations includes first determining whether torque control or diameter control is preferred. The operator then establishes the following joint parameters: fitting type, fitting size, fitting material, tubing diameter, tubing wall thickness and tubing material. Based on the preceding determinations and parameters, the appropriate tooling is then installed in the expander holder 34 and vise member 21. The tooling for the expander holder 34 is an expander assembly 10, which is internal tooling. The tooling for the vise member 21 comprises the top 35 and bottom 36 halves of the fitting jaw 37, and is the external tooling. Installation of internal and external tooling is described below.

Figure 4:
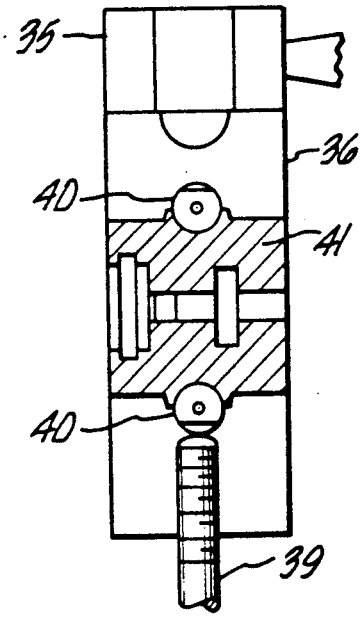
FIG. 4 is an enlarged fragmentary sectional elevational view of the vise member with the top machine jaw in the open position.
Figure 5:
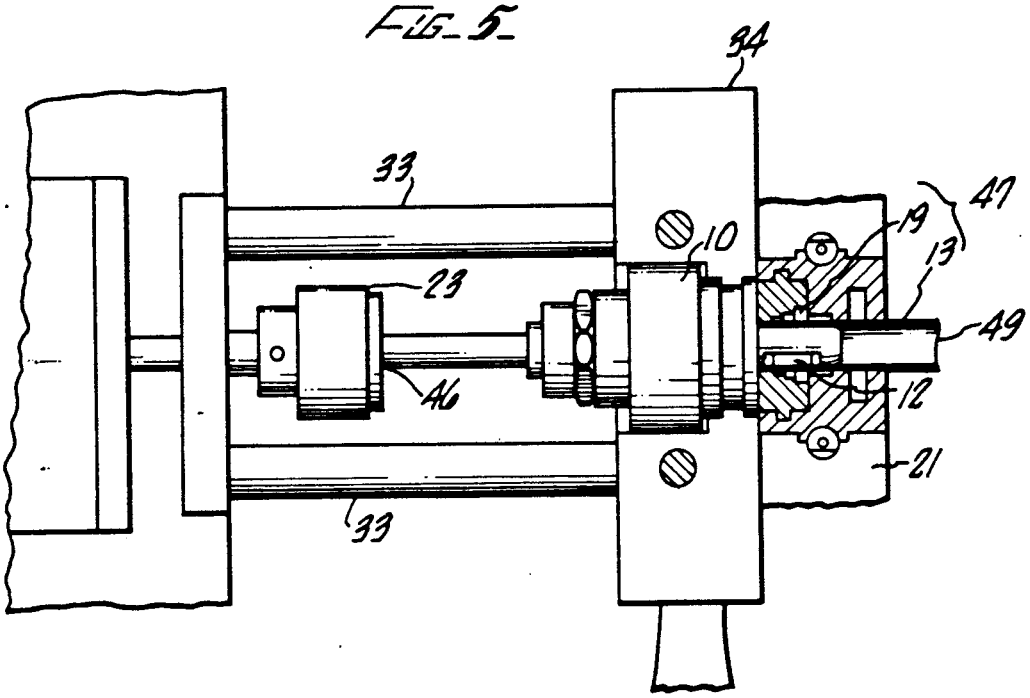
FIG. 5 is an enlarged fragmentary sectional top view of the insertion of the expander into the tube and sleeve held in place in the vise member.
Figure 6:
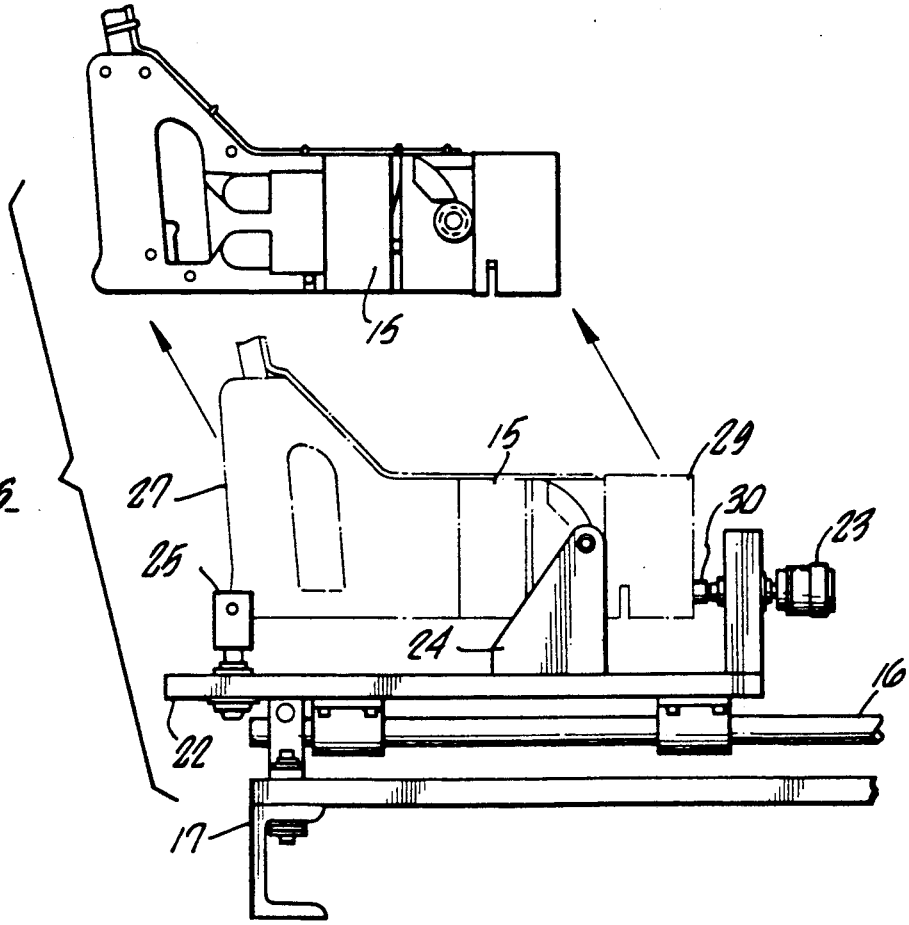
FIG. 6 is a side view illustrating removal of the drive motor from the slide table.

External tooling installation. Each type of fitting and size has a corresponding jaw consisting of two halves 35, 36. The tube 13 and the sleeve 19 are loaded into the vise member 21. With reference to FIG. 4 that is accomplished by rotating the machine jaw top 36 90 degrees to the full open position. One loosens the locking screws 38 on the half moon retainers 40 on both vise members 21. The half moon retainers 40 are rotated so that the flats face the jaw cavity 41. The fitting jaw halves 35, 36 and anvil 42 are inserted into the cavities of the top 35 and bottom 36 fitting jaws with the tube retainer 43 to the outboard side of the swager. The half moon retainers 40 are rotated 180 degrees so that the circular portion covers the fitting jaw. The locking screws 39 are then tightened.

Internal tooling installation. Each type of fitting and tube diameter/wall thickness combination has a corresponding expander assembly 10. The cover 44 of the tube expander holder 34 is removed. The expander assembly 10 is inserted into the expander holder 34 with the square end 45 of the mandrel 11 facing the connector 23. The expander cover 44 is replaced. One then engages the square end of the mandrel 45 into the connector 23 by sliding back a sleeve on the connector 23 and inserting the mandrel 45 into the square hole of the connector then releasing the sleeve. The insertion of the mandrel 45 into the square hole of the connector 46 is achieved by the relative longitudinal movement of the drive 14 and the expander assembly 10 along the mounting means 16 toward each other.

Tube and fitting installation. The tube/fitting assembly 47 is loaded into the bottom fitting jaw 36, with the tube 13 inserted fully against the anvil 42. The top fitting jaw 35 is then lowered to the closed position and locked by rotating the locking handle 48 and swinging a screw 39 pivotally mounted on locking handle 48 into the top vise member half 21 slot.

Adjustment of control means. One adjusts settings of control means 18 according to whether torque control or diameter control has been chosen for swage execution. According to the settings which have been manually selected on the control means 18, the drive motor 15 drives the tapered roller mandrel 11 at a constant speed.

Swage execution. At this point, the expander assembly 10, i.e internal tooling, and the fitting jaw halves 37; i.e. the external tooling, have been installed respectively in the expander holder 34 and the vise member 21; and the tube/fitting assembly 47 is in place in the fitting jaw halves 37 held in the vise member 21. The control means 18 has been adjusted.

Upon lubricating the tube expander rollers 12 with high pressure lubricant prior to the swage, the operator longitudinally moves the drive motor 15, which is connected to the mandrel 11, toward the tube/fitting assembly 47 held in place in the vise member 21. The tube expander 49 slides into the fitting composed of the tube/sleeve assembly 47 with the mandrel 11 in a position fully retracted toward the drive motor 15.

The swage is initiated by depressing the trigger 50 on the drive motor 15, which automatically rotates and self feeds the mandrel 11 into the tube 13 to expand the tube 13 into engagement with the tube/sleeve assembly fitting 47. The trigger 50 can be overridden by pin 51 inserted into hole 52.

After reaching the pre-selected torque or set diameter, the drive motor 15 will reverse automatically. While reversing, the operator pulls both the drive 14 and the expander holder 35 longitudinally along the shaft means 33 away from the fitting jaws 37 in the vise member where the tube-fitting assembly 47 is fixedly held. The mandrel 11 is thus retracted from the tube/fitting assembly 47.

Manual operating configuration.

The drive motor 15 can be removed from the portable frame 17 for converting from a bench-type machine for production to a transportable unit for on-site installation and repair. One unscrews the two shoulder screws mounted on the main bracket 24 and the shoulder screw on the balance bracket 25. The drive motor 15 is slid backward and lifted up, thereby freeing the torque sensor 29 from the drive shaft 30. One then follows a protocol for manual roller swaging, attaching the drive motor 15 to an expander assembly by means of a drive adapter and hand holding the drive motor during swage execution.

According to the above description, the machine is designed to install internally swaged fittings on tubing ¼" to 1¼" inclusive (6mm–32mm) outside diameter and comprises a swager drive motor 15 mounted on a portable frame assembly 17 for bench mounting and controller. The configuration of the swaging machine is approximately 26" (660 mm) in length, 10" (254 mm) in height, with an approximate weight of 96 lbs (43.6 kg). The machine can be converted from a portable bench-type machine for production to a transportable unit for on-site installation and repair by removing the drive motor 15 from the portable frame 17. For such use the drive motor 15 is hand held.

The machine can accommodate usage and utility requirements of different customers. Models operate on single phase electric power motors. European models operate on 220 volts, 50 hertz while other models operate on 110 volts, 60 hertz. Another model consists of a transportable swager drive motor and controller, packaged in a carrying case.

Having now fully described the invention, it will be apparent to one with ordinary skill in the art that many changes and modifications can be made thereto without departing from the spirit and scope of the invention as set forth herein.

What is claimed is:

1. A roller swaging machine for installing a metallic sleeve on a metallic tube by expanding the tube into engagement with the sleeve, the machine comprising:

(a) an expander assembly having a tapered mandrel for engaging a plurality of tapered rollers for expanding the tube as the mandrel is rotated and advanced on its axis;

(b) a drive for rotating the mandrel in a swaging cycle, the drive including a drive motor;

(c) control means for the drive to effect rotation of the mandrel to effect expansion of the tube; and (d) mounting means for the drive such that the drive motor is movably mounted relative to the expander assembly.

2. The machine of claim 1 including engaging means between the expander assembly and mounting means such that the expander assembly is movable on the mounting means.

3. The machine of claim 2 including a frame, and wherein the mounting means extends longitudinally from one end of the frame to the opposite end of the frame, and wherein at the opposite end of the frame, a vise member is rigidly mounted for anchoring the sleeve and tube.

4. The machine of claim 2 including a slide table and wherein the drive motor is mounted on the slide table, the table being movable on the mounting means.

5. The machine of claim 4 wherein pillow blocks are mounted between the slide table and the mounting means for facilitating movement of the drive motor on the mounting means.

6. The machine as claimed in claim 2 wherein the mounting means includes shaft means.

7. The machine of claim 1 wherein the drive includes handle means, the handle means facilitating manual movement of the drive motor.

8. The machine of claim 1 wherein the drive includes a transmission assembly and a torque sensor unit, and including a drive shaft for transmitting rotational movement for the expander assembly from the drive motor through the transmission assembly and the torque sensor.

9. The machine of claim 7 including a connector wherein the rotational output from the torque sensor unit drives the connector, the connector being for coupling with the expander assembly.

10. The machine of claim 1 wherein the mounting means is mounted on a portable frame.

11. The machine of claim 10 including mounting means extending longitudinally from one end of the frame to another, a slide table mounted to ride on the mounting means, the expander assembly being mounted to ride on the mounting means, and a stationary vise located at one end of the frame.

12. The machine of claim 11 wherein the slide table includes a connector for the expander assembly affixed at one end of the table, the remaining portion of the table being for mounting of the drive.

13. The machine of claim 10 wherein the control means is separately mounted from the frame and is electrically connected with a torque sensor.

14. The machine as claimed in claim 10 wherein the mounting means includes shaft means.

15. The machine of claim 1 wherein the control means is connected with a torque sensor, the torque sensor including a torque transducer, and electrical conductors connecting the torque transducer with the control means.

16. The machine as claimed in claim 15 wherein the mounting means includes shaft means.

17. The machine of claim 1 wherein the mounting means includes shaft means extending longitudinally toward the expander assembly.

18. The machine of claim 17 wherein the shaft means includes a plurality of laterally spaced shafts.

19. The machine as claimed in claim 17 wherein the mounting means includes shaft means.

20. A roller swaging machine for installing a metallic sleeve on a metallic tube by expanding the tube into engagement with the sleeve, the machine comprising:

(a) an expander assembly having a tapered mandrel for engaging a plurality of tapered rollers for expanding the tube as the mandrel is rotated and advanced on its axis;

(b) a drive for rotating the mandrel in a swaging cycle, the drive including a drive motor;

(c) control means for the rotation of the mandrel to effect expansion;

(d) mounting means for the drive such that the drive motor and the expander assembly are relatively movable;

(e) a connector for coupling the output from the drive with the expander assembly, and wherein the drive includes handle means, the handle means facilitating manual movement of the drive motor along the mounting means, and the mounting means includes a portable frame.

21. The machine of claim 20 wherein the drive includes a transmission assembly and a torque sensor unit, and including a drive shaft for transmitting rotational output for the expander assembly from the motor through the transmission assembly and the torque sensor.

22. A method for installing a metallic sleeve on a mechanical tube by roller-swaging wherein a mandrel is rotated and fed into the tube to expand the tube into engagement with the fitting comprising:

(a) operating the mandrel in a swaging cycle;

(b) controlling the operating action to effect rotation and feed of the mandrel; and (c) moving a drive motor longitudinally toward the mandrel to activate the mandrel.

23. The method as claimed in claim 22 wherein the drive motor is moved into engagement with an expander assembly housing the mandrel with mounting means extending longitudinally toward the expander assembly.

24. The method as claimed in claim 23 including moving the expander assembly along the mounting means.

25. The method as claimed in claim 24 wherein the expander assembly is moved along shaft means.

26. The method of claim 23 in which the drive motor is moved along shaft means extending longitudinally toward the expander assembly.

27. The method of claim 22 wherein the drive motor is moved into engagement with an expander assembly along a mounting means extending longitudinally from one end of a frame to the opposite end of the frame, and anchoring the sleeve and tube at the opposite end of the mounting means with a rigidly mounted vise member.

28. The method of claim 27 wherein shaft means extending longitudinally from one end of the frame to the opposite end anchors a rigidly mounted vise member.

29. The method of claim 28 including mounting the drive motor on a slide table, the table being movable along shaft means.

30. The method of claim 22 including mounting the drive motor on a slide table, the table being movable along mounting means.

31. The method of claim 22 including transmitting rotational movement from the drive motor through a transmission assembly and through a torque sensor to an expander assembly.

32. The method of claim 31 wherein the rotational output from the torque sensor drives a connector, the connector coupled to activate the expander assembly.

33. The method of claim 22 including driving the mandrel in a swaging cycle, moving the drive motor into engagement with an expander assembly such that the mandrel can be rotated, and moving the expander assembly forwardly along mounting means for feeding into the tube in a vise.

34. The method of claim 33 including moving the expander assembly forwardly along shaft means for feeding into the tube in a vise.

* * * * *